US005139298A

United States Patent [19]

Dowell

[11] Patent Number: 5,139,298

[45] Date of Patent: Aug. 18, 1992

[54] BINDER FOR HANGER-MOUNTED GARMENTS

[76] Inventor: Richard E. Dowell, 3631 Crenna Ave., Concord, Calif. 94519

[21] Appl. No.: 747,606

[22] Filed: Aug. 20, 1991

[51] Int. Cl.[5] ..... B65D 85/18; B65G 7/12

[52] U.S. Cl. ..... 294/145; 294/165; 206/279

[58] Field of Search ..... 294/142, 143, 145, 159, 294/162, 163, 165, 15; 206/279, 284, 285

[56] References Cited

U.S. PATENT DOCUMENTS

| | | | |
|---|---|---|---|
| 2,782,974 | 2/1957 | Borgfeldt | 294/159 X |
| 3,162,473 | 12/1964 | George | 294/15 X |
| 3,226,147 | 12/1965 | Marshall | 294/15 X |
| 3,317,055 | 5/1967 | Roscicki | 294/143 X |
| 3,566,456 | 3/1971 | London | 206/279 |
| 3,804,310 | 4/1974 | Wheeler | 294/142 |
| 4,045,067 | 8/1977 | Weider et al. | 294/15 X |
| 4,296,959 | 10/1981 | Helbig | 294/143 |
| 4,496,060 | 1/1985 | Anderson et al. | 206/279 X |
| 4,557,516 | 12/1985 | Usner | 223/88 |
| 4,640,414 | 2/1987 | Mobley et al. | 206/279 X |
| 4,844,257 | 7/1989 | Seynhaeve | 206/279 |

*Primary Examiner*—Margaret A. Focarino
*Assistant Examiner*—Dean J. Kramer
*Attorney, Agent, or Firm*—Schapp and Hatch

[57] ABSTRACT

A binder for binding together hanger-mounted garments is disclosed which includes an elongated spine of part-cylindrical cross-section, a pair of retainer mounting brackets carrying pins or tongues whereby a hanger hook retainer may be locked against the convex surface of the spine, and a lanyard for joining the retainer to one of the retainer mounting brackets. The retainer consists of an inner tubular member and an outer tubular member of resilient foam material.

2 Claims, 2 Drawing Sheets

BINDER FOR HANGER-MOUNTED GARMENTS

BACKGROUND OF THE INVENTION

1. Field of the Invention

My present invention relates to garment handling methods and apparatus, and more particularly to methods and apparatus for binding together multiplicities of hanger-mounted garments during the carrying thereof from one garment storage bar to another.

2. Description of the Prior Art

The term "prior art" as used herein or in any statement made by or on behalf of applicant means only that any document or thing referred to as prior art bears, directly or inferentially, a date which is earlier than the effective filing date hereof.

U.S. Pat. No. 4,045,067, granted to Rodney L. Wieder, et al., on Aug. 30, 1977, discloses APPARATUS AND METHOD FOR HANDLING GARMENT HANGERS. The Wieder, et al apparatus includes an elongated, planar scooping member, a handle, and a pair of struts, each strut joining one end of the scooping member to a corresponding end of the handle. The struts are so constructed and arranged as to maintain the plane of the scooping member at an angle of approximately 45° to a plane containing the axis of the handle and the axis of the scooping member. To remove garment hangers from a garment storage bar by means of the Wieder et al apparatus, the handle of the apparatus is positioned above the garment storage bar so that the upper edge of the scooping member is engaged with the free ends of the hanger hooks. The apparatus is then raised so that the hanger hooks become engaged with and solely supported by the scooping member, whereafter by raising the handle further the scooping member, bearing the garment hangers and the garments disposed thereon can be passed over the top of the garment storage bar, and the hangers thus freed from the garment storage bar while supported by the scooping member.

Thus, it will be seen that the user of the apparatus of Wieder et al must maintain the handle thereof well above the garment storage bar, and must raise the handle even higher in order to cause the scooping member to clear the garment storage bar. The effort involved in thus reaching well above the garment storage bar and thrusting the apparatus upward therefrom while bearing a load of hanger-mounted garments is clearly not within the ability of many potential users, such as female store clerks of short stature, and can produce back strain and other physical problems in users whose ability to operate the Wieder et al apparatus is marginal.

Further, it is apparent that the apparatus of Wieder et al must be maintained with its handle horizontal, essentially mandating two-hand operation. This necessity for two-hand operation, however, makes it difficult for the user of the Wieder et al apparatus to maximize the load carried thereby by gathering together the hooks of a maximum number of adjacent hangers on the garment storage bar from which those hangers are to be removed.

Yet further, no means is provided for retaining hanger hooks on the scooping member of the apparatus of Wieder et al, and thus the handle of the Wieder et al apparatus must be kept substantially horizontal during the entire movement from the garment storage bar of origin to the garment storage bar of destination, the user at all times maintaining the handle high enough so that the longest garment clears the floor, and at no time resting the joined garments on a table or the like.

U.S. Pat. No. 4,557,516, granted to Daniel G. Usner on Dec. 10, 1985, discloses a MULTIPLE GARMENT HANGER TRANSFER DEVICE. The device of Usner is adaptable for suspending a number of hanger-hung garments for vertical rope-sling loading, and is adaptable for skimming, in one continuous motion, a multiplicity of garment hangers from either a garment trolley bar or a garment storage bar, and clamping them together for transfer to said rope-sling. The device of Usner includes a longitudinally extending outer fixed jaw and a transversely movable, longitudinally extending inner jaw. The device of Usner includes a suspending hook whereby the device, and the hangers of garments supported thereby can be suspended from a rope-sling.

In the operation of the Usner device the jaws are manually parted, passed around the shanks of a plurality of hanger hooks, and the inner jaw released to clamp the hanger hook shanks between the jaws.

Thus, it will be seen that in the operation of the Usner device, while removing hanger hooks from their associated garment storage bar, the device must be moved upward while the hanger hook shanks are clampingly engaged between the jaws. Thus, in order to hang a plurality of hangers and the garments mounted thereon by means of the hook incorporated in the device the jaws must be repositioned from the shanks of the hooks to the upper parts of the hooks, all of which requires care and effort on the part of the user.

Yet further, the rigid, elongated faces of the jaws of the Usner device require that all of the hanger hooks be substantially alike, if the required frictional clamping engagement with the hanger hook shanks is to be maintained.

U.S. Pat. No. 3,162,473 issued to Warren T. George on Dec. 22, 1964, discloses a PORTABLE RACK for use in laundries, dry cleaning, clothing and other establishments for carrying numbers of hanger-mounted garments from place to place. The George device comprises a short garment storage bar which can be suspended by means of two hooks from an existing fixed garment storage bar, the short garment storage bar being provided at each end with a plate which is affixed to the short garment storage bar and perpendicular thereto. George further provides a handle upon which is mounted a clip adapted to receive and firmly engage any such plate.

The utilization of the invention of George, however, requires the purchase of a large number of such short garment storage bars, and thus is not well suited to domestic clothes storage use.

Further, the use of the George invention requires that there be considerable access room at at least one end of a short garment storage bar which is to be taken from the associated fixed conventional garment storage bar, which may in many cases involve considerable shifting of the short garment storage bars of the invention along the conventional storage bar, or the wastage of considerable lengths of the associated conventional fixed garment storage bars in order to leave room for end-access to the short garment storage bars of the invention.

Yet further, the use of the George device requires that the associated conventional fixed garment storage bars be elevated, or that additional clearance be required therebelow.

Additionally, the mode of grasping the handle of the George device, and inserting the user's forearm into the associated forearm yoke, produce a cantilever effect which requires strength on the part of the user which is not possessed by many persons.

It is believed that the documents listed immediately below contain information which is or might be considered to be material to the examination of this patent application.

U.S. Pat. No. 2,782,974
U.S. Pat. No. 3,226,147
U.S. Pat. No. 3,317,055
U.S. Pat. No. 4,296,959

No representation or admission is made that any of the above-listed documents is part of the prior art, or that no more pertinent information exists.

SUMMARY OF THE INVENTION

Accordingly, it is an object of my present invention to provide a binder for binding together a plurality of garment hangers and garments mounted thereon, which binder is capable of binding together garment hangers of different types.

Another object of my invention is to provide a binder for binding together a plurality of garment hangers and garments mounted thereon, which binder can be applied to a multiplicity of garment hangers mounted on a single conventional garment storage bar without disengaging the hangers from the storage bar.

Yet another object of my present invention is to provide a binder for binding together a multiplicity of garment hangers and garments mounted thereon, which binder can be applied to a multiplicity of garment hangers mounted on a single conventional garment storage bar when there is very little headroom above the storage bar.

A further object of my invention is to provide a binder for binding together a multiplicity of garment hangers and garments mounted thereon, which binder can be applied to a compressed group of garment hangers all of which are mounted on a single conventional garment storage bar without displacing adjacent hangers mounted on the same storage bar.

A yet further object of my present invention is to provide a binder for binding together a multiplicity of garment hangers and garments mounted thereon, with the aide of which binder a multiplicity of hanger-mounted garments may be transported from a first garment storage bar to a second garment storage bar without maintaining the binder horizontal and at shoulder level or above.

An additional object of my present invention is to provide a binder for binding together a multiplicity of garment hangers and garments mounted thereon, with the aide of which binder a multiplicity of hanger-mounted garments can be transported from a first garment storage bar to a second garment storage bar without the aide of an auxiliary garment storage bar segment suspended from said garment storage bar.

Another object of my present invention is to provide a binder for binding together a multiplicity of garment hangers and garments mounted thereon, which binder is highly compact, and thus is readily applied to a multiplicity of hanger-mounted garments in close quarters, e.g., in a bedroom clothes closet.

Yet another object of my present invention is to provide a binder for binding together a multiplicity of garments hangers and garments mounted thereon, which binder is light in weight and thus adds little to the burden of a human user engaged in transporting multiplicities of garments from a first garment storage bar to a second garment storage bar.

Other objects of my present invention will in part be obvious and will in part appear hereinafter.

My present invention, accordingly, comprises the several steps and the relation of one or more of such steps with respect to each of the others, and the apparatus embodying features of constructions, combinations of elements, and arrangement of parts which are adapted to effect such steps, all as exemplified in the following disclosure, and the scope of my present invention will be indicated in the appended claims.

In accordance with a principal feature of my present invention a binder for binding together a multiplicity of garment hangers and garments mounted thereon is comprised of a spine which is contoured to be rotatable over the top of a conventional garment storage bar, between the garment storage bar and the hook portions of the hangers.

In accordance with another principal feature of my present invention each end of said spine is provided with a retainer mounting bracket, by means of which retainer mounting brackets a hook retainer can be locked in confronting relation to said spine with the hook portions of the hangers of said multiplicity captive between said spine and said hook retainer.

In accordance with yet another principal feature of my present invention said hook retainer can be completely removed from said retainer mounting brackets.

In accordance with a yet further principal feature of my invention said hook retainer is attached to one of said retainer mounting brackets by means of a lanyard.

In accordance with an additional principal feature of my invention said hook retainer is comprised of a central substantially rigid tube upon which is mounted a hollow cylindrical body of resilient material, whereby hanger hooks of different types may be retained between said hook retainer and said spine.

In accordance with yet another principal feature of my invention one of said retainer mounting brackets is provided with a tongue which projects into the interior of one end of said tube when said hook retainer is locked to said spine in garment hanger hook retaining relationship therewith.

In accordance with yet another principal feature of my invention the other one of said retainer mounting brackets is provided with a spring-loaded, manually withdrawable tongue which projects into the interior of the other end of said tube when said hook retainer is locked to said spine in garment hanger hook retaining relationship thereto.

In accordance with another principal feature of my invention said hook retainer can be completely displaced from its garment hanger hook retaining relationship to said spine when said manually withdrawable tongue is manually withdrawn.

For a fuller understanding of the nature and objects of my present invention, reference should be had to the following detailed description, taken in accordance with the accompanying drawings.

DESCRIPTION OF THE PREFERRED EMBODIMENTS

The term "garment storage bar" is used herein in its broadest acceptation to denote any bar adapted to receive the hook portions of garment hangers and thus to support those garment hangers and any garments disposed thereupon, whether such bar is located in a retail establishment, in a home closet, in a garment factory, in a transport truck, or is a part of a garment transporting dolly or the like. Thus, the term "garment storage bar" as used herein embraces but is not limited to those bars sometimes referred to as "clothes poles", "garment bars", "garment trolley bars", "hanger bars", of whatever material and whatever cross section.

Figure 1:
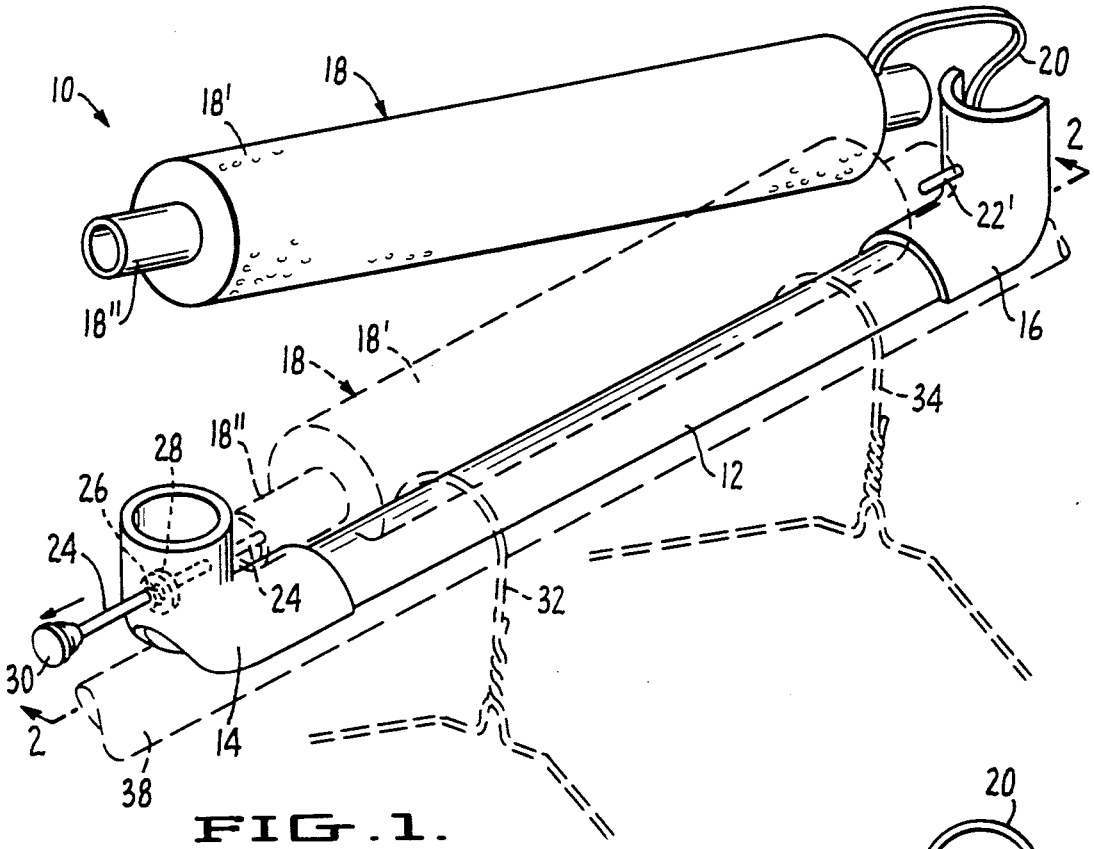
FIG. 1 is a perspective view of a hanger-mounted garment binder of my invention in operative relation to a garment storage bar and a plurality of hangers.

Referring now to FIG. 1, there is shown a hanger-mounted (hangered) garment binder 10 embodying my present invention.

As seen in FIG. 1, hangered garment binder 10 is comprised of a spine 12 to the opposite ends of which are affixed, respectively, a retainer mounting bracket 14 and a retainer mounting bracket 16.

As also seen in FIG. 1, a hanger hook retainer 18 is detachably mountable on spine 12 in the position indicated in phantom, and is tethered to mounting bracket 16 by means of a lanyard or tether link 20. Thus, retainer 18 can be withdrawn from its operative position shown in phantom in FIG. 1, e.g., to the position shown in solid lines, but cannot be completely detached from spine 12.

As further seen in FIG. 1, a pin or tongue 22' projects from retainer mounting bracket 16, and a retractable pin or tongue 24' projects from retainer mounting bracket 14. As shown in phantom, tongue 24' is the outer end of pin 24 which is mounted for longitudinal sliding in two holes, passing through opposite sides of retainer mounting bracket 14. Tongue 24' is normally maintained in its projecting position by means of a coil spring 26 which is captive between the wall of retainer mounting bracket 14 and a stop 28 which is itself affixed to pin 24. Pin 24 is provided at its outer end with a knob 30 which can be manually drawn away from mounting bracket 14, thus compressing spring 26 and withdrawing tongue 24' into mounting bracket 14.

Thus, as will be understood by those having ordinary skill in the art, informed by the present disclosure, retainer 18 may be locked to spine 12 in its operative condition shown in dashed lines by (1) manually retracting tongue 24' by drawing knob 30 outwardly from retainer mounting bracket 14, (2) positioning retainer 18 as shown in phantom in FIG. 1 with one of its open ends in engagement with tongue 22', and (3) releasing knob 30 so that tongue 24' becomes engaged with the other open end of retainer 18.

As further seen in FIG. 1, a pair of hanger hooks 32, 34 pass transversely across spine 12, the contour of which is such as to be receivable within the hanger hooks of all standard garment hangers. (Spine 12 is shown in cross-section in FIG. 4, as is the relationship of the outer contour of spine 12 to the hook of a standard wire garment hanger.)

As further seen in FIG. 1, hanger hooks 32, 34 are frictionally maintained on spine 12 by retainer 18 the resilient outer portion of which 18' is compressed against spine 12 by the coaction of tongues 22', 24' and the inner, rigid tubular portion 18" thereof.

While only two hangers 32, 34 are shown in FIG. 1 as being captive in and therefore bound together by binder 10, it will be understood by those having ordinary skill in the art, informed by the present disclosure, that a greater plurality of hangers can be bound together by binder 10, and that a corresponding plurality of garments each of which is mounted on one of these hangers bound will thus be bound together by binder 10.

As will also be evident to those having ordinary skill in the art, informed by the present disclosure, a larger plurality of hangers, each carrying a garment, can be bound together by binder 10 if the hooks of those hangers are first gathered together manually by pressing them together along the garment storage bar on which they are hung. By this means it has been discovered in the actual practice of my invention that as many as 24 garment hangers, and the garments borne thereby, may be bound together by a single binder of my invention substantially identical to binder 10 shown in the present drawings.

Figure 2:
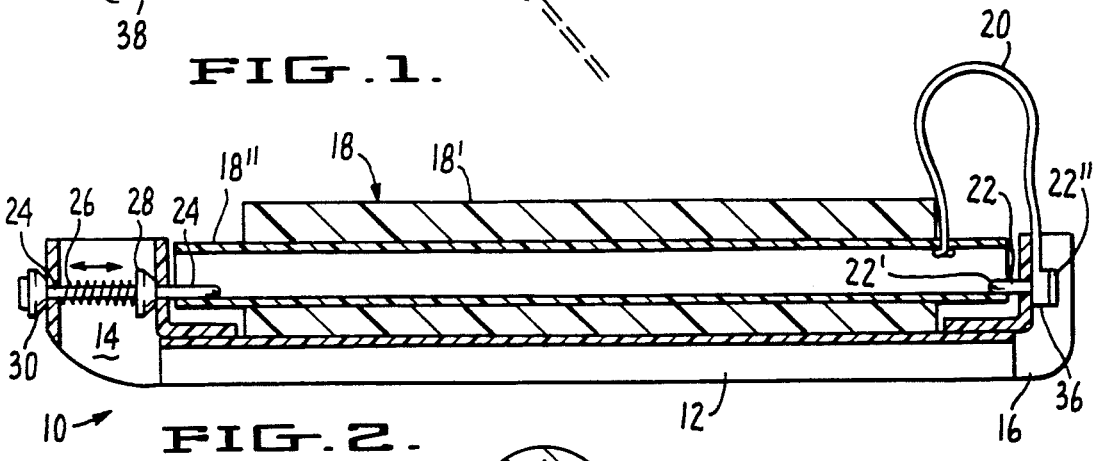
FIG. 2 is a vertical sectional view of the hanger-mounted garment binder of my invention shown in FIG. 1.

Referring now to FIG. 2, and comparing the same with FIG. 1, it will be understood by those having ordinary skill in the art that the two retainer mounting brackets 14, 16 are respectively affixed to opposite ends of spine 12, as by adherence with a suitable cement.

As also seen in FIG. 2, retainer 18 is comprised of an inner rigid tubular member 18" on which is mounted an outer resilient tubular member 18' fabricated, for example, from resilient foam material.

In the first preferred embodiment of my invention shown and described herein outer resilient foam member 18' close-fittingly engages inner tubular member 18" and thus is prevented from sliding therealong. However, the fit between outer resilient foam member 18' and inner rigid tubular member 18" is preferably such that outer member 18' is only forcibly rotatable about inner member 18", such that when one part of the outer surface of resilient foam member 18' becomes worn by contact with hanger hooks captive on spine 12 it can be slightly rotated about inner member 18", thus restoring the hanger hook gripping capacity of binder 10.

Figure 4:
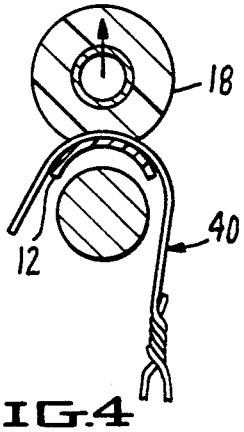
FIG. 4 illustrates the removal of a plurality of garment hangers from a garment storage bar by means of the binder of my invention shown in FIGS. 1 and 2.

As further seen in FIG. 2, the locations of tongues 22', 24' with respect to spine 12 and the wall thickness of resilient foam member 18' are such that when tongues 22', 24' are both received within inner tubular member 18" resilient foam member 18' is so compressed against spine 12 that an extended portion of its outer surface bears against spine 12, as seen in FIG. 4.

As further seen in FIG. 2, lanyard 20 is a plastic strand which is affixed at one end to rigid inner tubular member 18", as by passing through an aperture therein and then being thermally upset. The opposite end of lanyard 20 takes the form of a collar 36 through which the pin 22 which forms tongue 22' passes, and which collar is held captive by the head 22" of pin 22. Pin 22 passes through an aperture in the upstanding wall of retainer mounting bracket 16 and is fixedly retained in that aperture so that the projecting length of tongue 22' is invariable.

Figure 3:
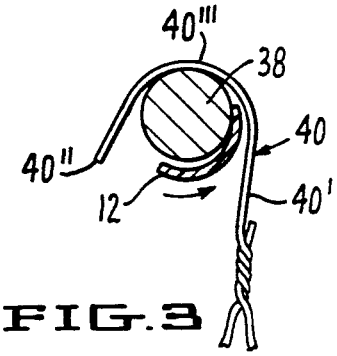
FIG. 3 illustrates the mode of engaging the hanger-mounted garment binder of FIGS. 1 and 2 with a plurality of garment hangers supported by a garment storage bar in accordance with the method of my invention.

Referring now to FIG. 3, there is schematically illustrated the method of inserting the spine 12 of binder 10 between a hanger hook 40 and a garment storage bar 38 with which it is engaged, which method is a principal feature of my invention. (It is to be noted that the user stands at the right in FIGS. 3, 4, and 5.)

As seen in FIG. 3, hanger hook 40 includes a shank portion 40', an outer end or tip 40", and an intermediate or central portion 40'''.

It is further to be understood that before carrying out the method illustrated in FIG. 3, retainer 18 is disengaged from spine 12 by pulling outwardly on knob 30 (FIG. 1).

Binder 10 is then so manipulated that the concave face of spine 12 is upwardly presented toward the lower part of garment storage bar 38 as seen in FIG. 3.

With binder 10 so positioned that spine 12 is juxtaposed to garment storage bar 38 as seen in FIG. 3, binder 10 is then manually grasped by mounting brackets 14, 16, and rotated about garment storage bar 38 in a counterclockwise direction as shown in FIG. 3 until spine 12 is on top of garment storage bar 38 and located between garment storage bar 38 and hanger hook 40.

After the positioning of spine 12 between garment stoage bar 38 and hanger hook 40 as abovedescribed retainer 18 is returned to its position above spine 12 as shown in phantom in FIG. 1, and is locked in that position by engaging the tubular inner member of retainer 18 with tongues 22, 24', as described hereinabove in connection with FIG. 1.

Figure 5:
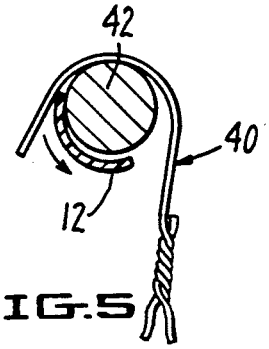
FIG. 5 illustrates the mode of disengaging the hangered garment binder of my invention from a plurality of garment hangers disposed on a garment storage bar which is a principal feature of the method of my invention.

Thereafter, as seen in FIG. 4, hanger hook 40 and any other hanger hooks then passing over spine 12, and any garments borne by the associated hangers, all joined together by binder 10, can be lifted free of garment storage bar 38, freeing binder 10 and the hangers and garments bound together thereby to be carried as a single bound-together unit to a second garment storage bar 42 (FIG. 5).

Referring now to FIG. 5, there is shown the method of disengaging spine 12, and thus binder 10, from the garment storage bar 42 of destination, leaving the hanger hooks carried to the garment storage bar 42 in suspended engagement with garment storage bar 42, which method is a principal feature of my invention.

When binder 10 and the hangers bound together thereby are deposited on garment storage bar 42, by depositing binder 10 on storage bar 42, retainer 18 is still locked to the top of spine 12 in the manner shown in FIG. 4.

The next step of this method of my invention, then, is to unlock retainer 18 from spine 12 by means of retractable pin 24, as abovedescribed, and to remove retainer 18 from its operative position.

Spine 12 is then manually rotated about garment storage bar 42 (in the counterclockwise direction as shown in FIG. 5) until spine 12 is substantially directly below clothes storage bar 42, and is no longer in contact with hanger hook 40, or any other hanger just previously engaged in binder 10.

Once spine 12 has thus been rotated into a position below garment storage bar 42, and is free of hanger hook 40 and the hooks of any other hangers just previously clamped in binder 10, spine 12 can be moved downward (toward garments suspended on said hangers until it is clear of the tips of said hanger hook or hooks, whereafter it can be drawn rearward (leftward in FIG. 5) and completely freed from garment storage bar 42, hanger hook 40, and any other hanger hooks just previously engaged in binder 10.

Figure 6:
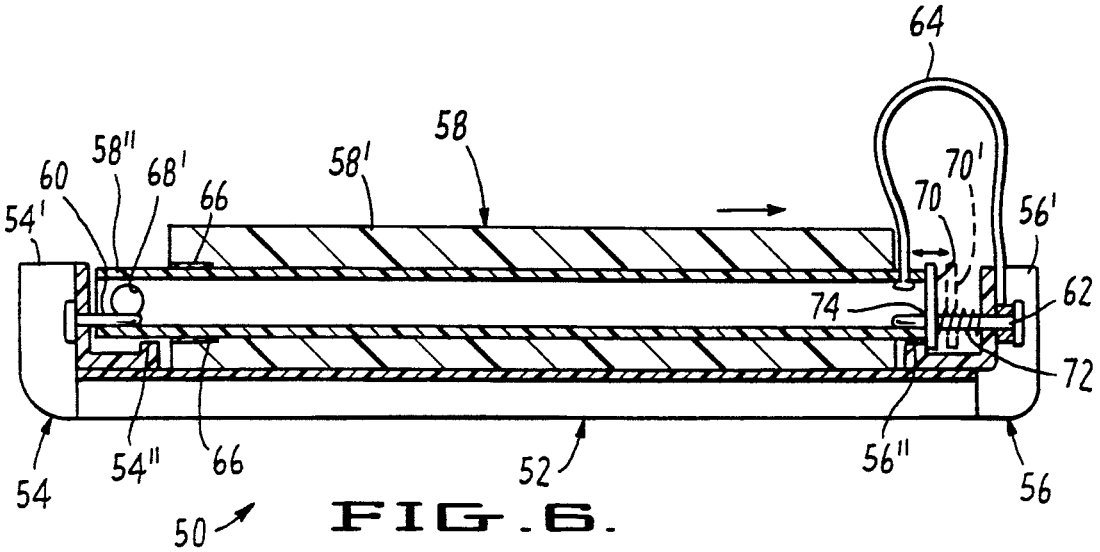
FIG. 6 is a vertical sectional view of a hanger-mounted garment binder of the second preferred embodiment of my invention.

Referring now to FIG. 6, there is shown in vertical cross-section a hangered garment binder 50 of the second preferred embodiment of my invention.

Garment binder 50 is comprised of a spine 52 which is substantially identical to spine 12 of the first preferred embodiment of my invention as shown in FIG. 1.

Garment binder 50 is further comprised of retainer mounting brackets 54 and 56. The respective body portions 54' and 56' of mounting brackets 54 and 56 are substantially identical to the body of mounting bracket 16 of FIG. 1, except for the provision of flanges 54", 56" which prevent hanger hooks from escaping from spine 52 onto the horizontal portions of mounting brackets 54, 56.

Garment binder 52 is further comprised of a retainer 58 which is substantially identical to retainer 18 of FIG. 1, except as hereinafter described.

Retainer 58 is comprised of a resilient outer sheath 58' and an inner tubular core 58", both of which are substantially identical to the corresponding elements 18', 18" shown in FIG. 1, except as hereinafter described.

As will be evident to those having ordinary skill in the art, informed by the present disclosure, garment binder 50 differs principally from garment binder 10 of the first preferred embodiment shown in FIG. 1 in the means for attaching retainer 58 to mounting brackets 54, 56.

Referring again to FIG. 6, it will be seen that one end of retainer 58 is attached to bracket 54 by means of a fixed pin 60, which pin 60 is fixed in an aperture passing through bracket 54, and thus is immovable with respect to bracket 54. Retainer 58 is movable with respect to pin 60, as is retainer 18 movable with respect to pin 22' in FIG. 1.

Similarly, pin 62 (FIG. 6) is fixed in an aperture in bracket 56, and thus is immovable with respect to bracket 56.

Tether 64 (FIG. 6) is substantially identical to tether 20 of FIG. 1, and serves the same purpose.

It is to be noted in FIG. 6 that the end of resilient sheath 58' of retainer 58 is affixed to tubular core 58" by means of a layer of suitable adhesive 66.

Further, a pair of openings 68', 68" (not shown) are provided in the end of core 58" adjacent bracket 54, whereby the user can more positively grip core 58" with the fingers of one hand.

As further seen in FIG. 6, the end of core 58" adjacent bracket 56 projects from resilient sheath 58' less than core 18" of FIG. 1 projects from sheath 18' of FIG. 1, thus providing space for the sliding spring latch which is a principal feature of the garment binder of the second preferred embodiment of my invention shown in FIG. 6.

Referring again to FIG. 6, it will be seen that a plate 70 is longitudinally slidably mounted on pin 62, and that a coil spring 72 is provided for resiliently urging plate 70 against the end of tubular core 58". A raised portion 74 of pin 62 is provided whereby plate 70 is retained on pin 62. In addition, coil spring 72 may be fastened to plate 70 and to bracket 56 in well known manners.

As will now be evident to those having ordinary skill in the art, informed by the present disclosure, retainer 58 may easily be removed from spine 52 by grasping retainer 58, thrusting it toward bracket 56 against the urging of spring 72, and separating it from spine 12 when its left end (FIG. 6) clears pin 60.

Retainer 58 may be reattached to spine 12 by engaging its right end (FIG. 6) with pin 62, thrusting retainer 58 rightwardly (FIG. 6) against the urging of spring 72, aligning its left end with pin 60, and then permitting the urging of spring 72 to engage the left end of core 58" with pin 60.

Figure 7:
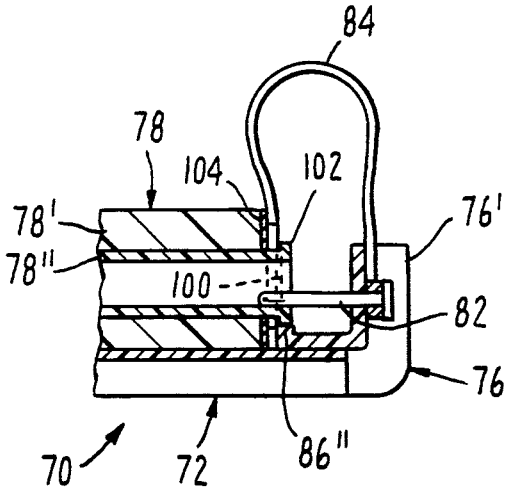
FIG. 7 is a vertical sectional views of a hanger-mounted garment binder of the third preferred embodiment of my invention.

Referring now to FIG. 7, there is shown a partial sectional view of a garment binder 70 of the third preferred embodiment of my invention.

It is to be understood that garment binder 70 of the third preferred embodiment of my invention is substantially identical to garment binder 50 of the second preferred embodiment of my invention with the exception of the specific differences described in detail hereinbelow and shown in FIG. 7.

For this reason, the parts common to the second and third preferred embodiments will be referred to in FIG. 7 by reference numerals which are greater by twenty than the reference numerals used in FIG. 6 to designate the same parts.

Thus it will be understood, for example, that spine 72 shown in FIG. 7 is substantially identical to spine 52 shown in FIG. 6, and that bracket 76 shown in FIG. 7 is substantially identical to bracket 56 shown in FIG. 6.

Further, retainer 78 shown in FIG. 7 is substantially identical to retainer 58 shown in FIG. 6, core 78" shown in FIG. 7 is substantially identical to core 58" shown in FIG. 6, sheath 78" shown in FIG. 7 is substantially identical to sheath 58" shown in FIG. 6, etc.

This mode of designating parts common to the second and third preferred embodiments is also applied to parts not shown in FIG. 7. Thus, it will be understood that pin 80 of the third preferred embodiment, which is not shown in FIG. 7, is substantially identical to pin 60 shown in FIG. 6, except as described hereinafter.

Referring now to FIG. 7, and comparing it with FIG. 6, it will be seen that pin 82 is not provided with a plate similar to plate 70 of FIG. 6, and is not provided with a coil spring similar to coil spring 72 of FIG. 6.

Further, it will be seen in FIG. 7 that tether 84 ends in a loop 100 which surrounds core 78", and that core 78" is provided with a flange 102 whereby loop is held captive on core 78". Thus, since loop 100 is captive on core 78" but loosely surrounds core 78", it follows that in the third preferred embodiment shown in FIG. 7 retainer 78 can be freely rotated about its own axis, so that when a part of the outer surface of sheath 78" becomes worn from contact with hangers it can be rotated to present a new, unworn face portion to spine 72.

As also seen in FIG. 7, a rigid or semi-rigid discate member 104 is applied to the end of sheath 78', surrounding core 78". A similar discate member is preferably applied to the opposite end of sheath 78'.

These discate members are fabricated from thin sheet material which is far more resistant to wear, abrasion, and cutting than is the resilient foam or like material of sheath 78'.

It is also to be noted that in the third preferred embodiment shown in FIG. 7, the length of pin 80 (corresponding to pin 60 of FIG. 6) is such that when discate member 104 is in contact with flange 86" but not forcefully pressed thereagainst pin 80 extends a short distance, e.g., ⅛th inch, into its associated end of core 78".

Thus, in order to disengage pin 80 from core 78" retainer 78 must be manually thrust to the right as seen in FIG. 7; and to reattach retainer 78 to spine 72 core 78" must be engaged with pin 82 and then thrust to the right as seen in FIG. 7 until pin 80 can be engaged with the other end of core 78", thus compressing the portion of sheath 78' adjacent flange 86", whereafter a slight leftward thrust of retainer 78 will engage pin 80 with core 78", attaching retainer 78 to spine 72, in which condition pins 80 and 82 are both engaged with core 78" and retainer 78 is prevented from shifting to the right (FIG. 7), and thus disengaging from pin 80 by the limiting action of possible contact between sheath 78' and flange 86".

Thus, it will be seen by those having ordinary skill in the art that in the third preferred embodiment resilient sheath 78' serves essentially the same function as that served by coil spring 72, etc., in the second preferred embodiment.

It will thus be seen that the objects set forth above, among those made apparent from the preceding description, are efficiently attained, and since certain changes may be made in the above constructions and the method carried out thereby without departing from the scope of my present invention, it is intended that all matter contained in the above description or shown in the accompanying drawings shall be interpreted as illustrative only, and not in a limiting sense.

In a further preferred embodiment of my invention spring 26 may be eliminated in favor of a two-position detenting mechanism whereby pin 24 may be locked by detenting in either its tongue-withdrawn position or its tongue-projecting position illustrated in FIG. 2.

It is further to be noted that my invention is not limited to retainer mounting brackets taking the particular form shown in FIG. 1. Thus, the upstanding wall portion of retainer mounting bracket 16 need not be of parti-cylindrical form as in the first preferred embodiment. Further, retainer mounting bracket 14 need not be of the cylindrical form shown in FIG. 1. Yet further, tether 20 need not be a single strand of plastic material, but may be formed from cord, chain, or the like.

It is also to be understood that the following claims are intended to cover all of the generic and specific features of my invention hereindescribed, and all statements of the scope of my invention which, as a matter of language, might be said to fall therebetween.

What is claimed is:

1. A binder for binding together multiplicities of hanger-mounted garments, comprising:

an elongated spine member having a concave face and a convex face;

an elongated hanger hook retaining member; and mounting means for detachably mounting said retaining member on said spine member in confronting relation to said convex face whereby to clamp a plurality of hanger hooks to said spine member;

said retaining member being comprised of a cylindrical core member on which is disposed a sheath of resilient material having a cylindrical outer surface, said retaining member thus being faced with resilient material.

2. A binder for binding together multiplicities of hanger-mounted garments, comprising:

an elongated spine member having a concave face and a convex face;

an elongated hanger hook retaining member;

mounting means for detachably mounting said retaining member on said spine member in confronting relation to said convex face whereby to clamp a plurality of hanger hooks to said spine member; and a flexible tether for tethering said retaining member to said spine member;

said retaining member being comprised of a cylindrical core member on which is disposed a sheath of resilient material having a cylindrical outer surface, said retaining member thus being faced with resilient material.

* * * * *